United States Patent [19]

Higuchi et al.

[11] Patent Number: 4,946,748

[45] Date of Patent: Aug. 7, 1990

[54] HIGHLY ANTICORROSIVE COATED STEEL SHEET FOR FUEL VESSEL AND PROCESS FOR PRODUCTION THEREOF

[75] Inventors: Seijun Higuchi; Kenichi Asakawa; Toshinori Mizuguchi; Minoru Fujinaga, all of Kitakyushu, Japan

[73] Assignee: Nippon Steel Corporation, Tokyo, Japan

[21] Appl. No.: 425,519

[22] Filed: Oct. 19, 1989

Related U.S. Application Data

[63] Continuation of Ser. No. 207,922, Jun. 13, 1988, abandoned, which is a continuation of Ser. No. 907,688 filed as PCT JP85/00727 on Dec. 27, 1985, published as WO86/04098 on Jul. 17, 1986, abandoned.

[30] Foreign Application Priority Data

Dec. 30, 1984 [JP] Japan ..... 59-281056

[51] Int. Cl.[5] ..... B32B 15/04; B32B 15/18; C25D 5/10; C25D 5/48

[52] U.S. Cl. ..... 428/644; 428/643; 428/645; 428/677; 428/679; 428/684; 204/35.1; 204/38.4; 204/40; 204/43.1; 204/44.4; 204/44.5; 204/44.7

[58] Field of Search ..... 204/35.1, 37.3, 38.1, 204/38.4, 40, 43.1, 44.4, 44.5, 44.7; 428/615, 617, 635–638, 643, 644, 645, 646, 648, 681–685, 935, 677, 679

[56] References Cited

U.S. PATENT DOCUMENTS 4,013,488 3/1977 Ramquist et al. ..... 428/643 X
4,082,621 4/1978 Spiliotis et al. ..... 428/646 X
4,413,039 11/1983 Higuchi et al. ..... 428/643

FOREIGN PATENT DOCUMENTS 1082283 12/1954 France .
2235208 1/1975 France .
321407 10/1929 United Kingdom .

OTHER PUBLICATIONS

*The Iron Age,* vol. 3, No. 199, Jan. 19, 1967, pp. 62–63 "Lead Phosphate Protects Steel And Preserves its Weldability".

*Patent Abstracts of Japan,* vol, 8, No. 130 (C-229) (1567), Jun. 16, 1984–JP–A–59–41459.

European Search Report, Application No. EP 86 90 0284

International Search Report, Application No. PCT/JP85/00727.

*Primary Examiner*—John F. Niebling
*Assistant Examiner*—Ben C. Hsing
*Attorney, Agent, or Firm*—Kenyon & Kenyon

[57] ABSTRACT

Disclosed is a coated steel sheet valuable for the production of a fuel vessel, in which a first covering layer comprising a Pb-Sn alloy as the main component is formed on a substrate comprising a steel sheet and an undercoat covering layer composed of at least one member selected from Ni, Co and Cu, which is formed on the surface of the steel sheet according to need, a second covering layer containing a compound containing Pb and P is formed on the first covering layer, a third covering layer containing at least one member selected from Sn, Ni and Co is formed on the second covering layer, and according to need, the surface portion of the third covering layer is modified with a treating liquid containing a phosphoric acid ion or a chromic acid ion. This coated steel sheet shows a highly improved corrosion resistance, forming processability, solderability, and weldability.

14 Claims, No Drawings

HIGHLY ANTICORROSIVE COATED STEEL SHEET FOR FUEL VESSEL AND PROCESS FOR PRODUCTION THEREOF

This application is a continuation, of application Ser. No. 207,922 filed June 13, 1988 which is a continuation, of application Ser. No. 907,688 filed as JP85/00727 on Dec. 27, 1985, published as WO86/04098 on Jul. 17, 1986 both now abandoned.

TECHNICAL FIELD

The present invention relates to a coated steel sheet having an excellent corrosion resistance and forming processability, which is valuable for forming a vessel for containing gasoline, an alcohol fuel, or an alcohol-gasoline mixed fuel.

BACKGROUND ART

A so-called terne-coated steel sheet coated with a lead-tin alloy formed by adding 3 to 25% of tin to lead has been heretofore used for, for instance, automobile fuel vessels (gasoline tanks). This steel sheet has a good corrosion resistance and processability and is advantageous from an economical viewpoint.

Due to recent problems with the supply conditions of petroleum (increase in the cost of and decrease in the amount produced petroleum), and in line with present efforts to find an alternative to gasoline as a fuel, attempts have been made to use an alcohol fuel such as methyl alcohol or ethyl alcohol, or a mixed fuel (so-called gasohol) formed by incorporating an alcohol such as methyl alcohol, ethyl alcohol or isopropyl alcohol into gasoline, instead of gasoline.

The lead-tin alloy-coated steel sheet heretofore used for an automobile fuel vessel does not have sufficient corrosion resistance when used for a vessel for containing such as alcohol fuel or alcohol-added gasoline (gasohol).

More specifically, the lead-tin alloy-coated steel has a covering layer formed of a lead-tin eutectic alloy composed mainly of lead, and the corrosion resistance of the lead-tin alloy-coated steel sheet to alcohol-containing fuels is drastically degraded, mainly for the following reasons.

(1) The corrosion resistance of the lead metal to methyl alcohol, ethyl alcohol, and the like, is very low and lead metal is severely corroded by such an alcohol. Accordingly, the lead metal portion in the lead-tin alloy covering layer is easily corroded.

(2) Usually, an alcohol contains water. When an alcohol is incorporated in gasoline, a phase containing water in a large amount separates from the gasoline-alcohol mixed phase. Therefore, if pinholes are formed in the lead-tin alloy covering layer, corrosion of the lead-tin alloy covering layer by the water-containing phase is promoted.

Accordingly, a material in which a much smaller number of pinholes are formed in the covering layer, compared with the number of pinholes formed in the conventional material, and having an excellent resistance to corrosion by an alcohol or alcohol oxide, is strongly desired as a material for forming a vessel for an alcohol-containing fuel, for example, an automobile fuel tank.

The need to improve the corrosion resistance in a material of a fuel vessel is increasing, not only for the inner surface of the fuel vessel but also for the outer surface of the fuel vessel.

More specifically, it is necessary to develop a highly anticorrosive material for forming a covering layer in which the number of pinholes is reduced, and which has a high resistance to corrosion caused by salt scattered over the surface of roads, etc., to prevent icing thereof in winter.

As a material satisfying this requirement, we previously produced a steel sheet having a surface covering layer composed of tin, cobalt, nickel, or an alloy thereof, which as an excellent resistance to corrosion by an alcohol or alcohol-containing fuel, this surface covering layer being formed on a covering layer composed of a lead-tin alloy, as shown in Japanese Unexamined Patent Publication (Kokai) No. 59-104496, and relatively good results were obtained according to this proposal.

The above steel sheet is characterized in that, in order to solve the problem of a low corrosion resistance to alcohol-containing fuel or alcohol fuel in a lead-tin alloy-coated steel sheet heretofore used for an automobile fuel vessel, a covering layer composed of tin, nickel, cobalt, or an alloy thereof, which has an excellent resistance to corrosion by alcohol fuel or alcohol-containing fuel, is formed as the surface layer covering the lead-tin alloy-coating layer. Furthermore, other characteristics (for example, forming-processability, solderability, and weldability) of the lead-tin alloy-coated steel sheet required for the fuel vessel material are retained in this fuel vessel material, and a fuel vessel material practically applicable to an alcohol fuel or alcohol-containing fuel vessel can be provided.

However, from the results of experiments, it has been found that when this steel sheet is exposed to an alcohol-containing fuel, an alcohol fuel, or water containing a chlorine ion ($Cl^-$), a satisfactory and stable corrosion resistance cannot be always obtained.

More specifically, in the above steel sheet, since pinholes in the covering layer of the above-mentioned metal or alloy of the lead-tin alloy-coated steel sheet are enlarged according to the processed shape of the fuel vessel, red rust often appears on the steel sheet. The water content in alcohol-containing fuel is high (at least about 0.75% based on the alcohol contained in the fuel), and when the phase containing water in a large amount is separated from the other phase, red rust spots often appear in the portion of the steel sheet in contact with the water-containing phase. Thus, it has been confirmed that the above coated steel sheet still does not have sufficient resistance to corrosion by the above-mentioned fuels.

Moreover, in a corrosion test of the outer surface of the fuel vessel with an aqueous solution containing a chlorine ion ($Cl^-$), it was found that many spots of red rust appear on the outer surface of the vessel which has been subjected to a severe forming process.

Accordingly, where pinholes extending to the substrate of the steel sheet are present, pitting corrosion is caused in the substrate of the steel sheet contained in the fuel or the $Cl^-$ ion or water contained in the surrounding atmosphere, and the above-mentioned coated steel sheet is defective in that the life of the steel sheet vessel against such corrosion is not practically sufficient.

DISCLOSURE OF THE INVENTION

An object of the present invention is to provide a coated steel sheet for a highly anticorrosive fuel vessel, which has excellent corrosion resistance, weldability, and forming processability, and which shows a high resistance to corrosion by water or a chlorine ion ($Cl^-$) even when subjected to a severe forming process, and a process for the production of this coated steel sheet.

Another object of the present invention is to provide a coated steel sheet for a highly anticorrosive fuel vessel, which has a highly improved corrosion resistance and forming processability, compared to the conventional coated steel sheet, comprising a lead-tin alloy covering layer and a layer composed of at least one member selected from tin, nickel, and cobalt, which is formed on the alloy layer, and a process for the production of this coated steel sheet.

More specifically, in accordance with the present invention, the coated steel sheet for a highly anti-corrosive fuel vessel comprises a substrate composed of a steel sheet, at least one first covering layer formed on at least one surface of the substrate, which first covering layer contains an alloy of lead and tin as the main component, at least one second covering layer formed on the first covering layer, which second covering layer contains a compound containing lead and phosphorus and at least one third covering layer formed on the second covering layer, which third covering layer contains at least one metal selected from tin, nickel, and cobalt, or an alloy thereof, as the main component.

Moreover, in the coated steel sheet of the present invention, the surface portion of the third covering layer may be modified by a chemical conversion treatment.

Furthermore, in accordance with the present invention, there is provided a process for the production of a coated steel sheet for a highly anticorrosive fuel vessel, which comprises forming a first covering layer containing an alloy of lead and tin as the main component on at least one surface of a substrate composed of a steel sheet, subjecting the first covering layer to a treatment with an aqueous treating liquid containing a phosphoric acid ion at a concentration of 0.1 to 100 g/l for 1 to 10 seconds, to form a second covering layer containing a compound containing lead and phosphorus on the first covering layer, and forming a third covering layer containing a metal selected from tin, nickel, and cobalt, or an alloy thereof, as the main component on the second covering layer according to an electric plating method.

In the process of the present invention, the substrate may be prepared by forming an undercoat covering layer, consisting of at least one member selected from nickel, cobalt and copper, on at least one surface of the steel sheet.

Also, in the process of the present invention, the surface portion of the third covering layer may be modified by a chemical forming treatment. Preferably, an aqueous solution containing a phosphoric acid ion is used for this chemical forming treatment.

BEST MODE FOR CARRYING OUT THE INVENTION

In the coated steel sheet of the present invention, a first covering layer containing a lead-tin alloy as the main component is formed on at least one surface of a substrate composed of a steel sheet. This lead-tin alloy layer may be formed according to a hot dip coating method or electric plating method.

The first covering layer may be formed directly on the surface of a substrate composed of a steel sheet which has been subjected to a cleaning or activating treatment. Alternately, there may be adopted a method in which an undercoat covering layer composed of at least one member selected from nickel, cobalt, and copper is formed on the surface of steel sheet which has been subjected to a cleaning or activating treatment and first covering layer as described above is formed on this undercoat covering layer.

When forming the first covering layer, preferably the number of pinholes is reduced as much as possible. In order to form a first covering layer having a reduced number of pinholes, preferably a substrate having an undercoat covering layer as described above is used.

Namely, a first covering layer having a reduced number of pinholes is formed by a laminating effect caused by laminating the undercoat covering layer and the first covering layer and an effect of forming a dense lead-tin alloy covering layer by the reaction of tin in a lead-tin alloy plating solution with the undercoat covering layer.

In the coated steel sheet of the present invention, preferably the thickness of the first covering layer is 1.5 to 10 μm, especially 2.5 to 7.5 μm. When the thickness of the first covering layer is less than 1.5 μm, even if the second covering layer is formed on the first covering layer, the obtained coated steel sheet has many pinholes and the corrosion resistance thereof is not sufficient. If the thickness of the first covering layer exceeds 10 μm, the forming processability of the coated steel sheet is sometimes unsatisfactory and the manufacturing cost is increased.

Where the undercoat covering layer is formed below the first covering layer, in view of the need to reduce the number of pinholes, preferably the thickness of the undercoat covering layer is at least 0.01 μm, especially at least 0.03 μm, and in view of the forming processability, preferably, the thickness of the undercoat covering layer is smaller than 1 μm. Ordinarily, the undercoat covering layer is composed of at least one number selected from nickel, cobalt, and copper, and has a thickness of 0.5 μm or less but not less than 0.03 μm.

In the coated steel sheet of the present invention, the composition of the lead-tin alloy constituting the first covering layer is not particularly critical, but preferably, the tin content is 3 to 30% by weight. If the tin content in the first covering layer is within the range of 3 to 30% by weight, since there is little reaction of the tin with the steel sheet or the undercoat covering layer formed on the surface of the steel sheet, the weldability at the step of forming the fuel vessel is improved. However, if the tin content is lower than 3% by weight, coagualation of the first covering layer into granules in the heat-melted portion occurs at the welding step, and a satisfactory weld cannot be obtained, and when the first covering layer is formed according to the hot dip coating method, the number of pinholes formed is increased and it is difficult to form a covering layer having a smooth surface. If the tin content exceeds 30% by weight, there is a saturation in the effect of reducing the number of pinholes by the incorporation of tin, and accordingly, the incorporation of such a large amount of tin is not preferable from an economical viewpoint. In general, the tin content in the first covering layer is preferably at least 5% by weight.

In the coated steel sheet of the present invention, up to 3% by weight of zinc and/or may be contained in the first covering layer.

In the coated steel sheet of the invention, it is important that the second covering containing a compound containing lead and phosphorus and should be formed on the first covering layer comprising a lead-tin alloy as the main component. This second layer may be continuous or discontinuous, or may contain a discontinuous portion.

The second covering layer is composed mainly of a lead phosphate type compound containing lead and phosphorus as main elements. This second covering layer covers and clogs pinholes of the first covering layer and prevents corrosion of the steel sheet stemming from the pinhole portion. Furthermore, the lead-phosphorus compound and a small amount of a tin phosphate type compound in the second covering layer prevents the growth and enlargement of pinholes in the first covering layer caused when the third covering layer is formed on the second covering layer according to an electric plating method. Namely, when the third layer is formed according to an electric plating method, pinholes in the first covering layer are enlarged by the action of phenolsulfonic acid or a fluoborate or chloride contained in the plating solution, or new pinholes are formed by the dissolution of the thin portion of the first covering layer by this action. The so-enlarged pinholes or newly formed pinholes can be covered to a considerably extent with the third covering layer, but it is difficult to completely cover and hide these pinholes. Especially when the steel sheet is subjected to a severe forming process, pinholes are enlarged or the third and second covering layers are damaged, with the result that the corrosion resistance of the coated steel sheet is degraded.

The corrosion of the coated steel sheet, which is due to the presence of pinholes in the first covering layer, can be prevented by forming the second covering layer between the first and third covering layer according to the present invention. Enlargement of pinholes in the first covering layer, which is caused when the third covering layer is formed according to the electric plating method, or the formation of the new pinholes, may be prevented by other methods, for example, a method in which a coating composed mainly of lead sulfate is formed on the first covering layer. According to this method, however, the coating layer containing a lead compound inhibits the adhesion between the first and third covering layers or reduces the uniformity of the electrodeposition, and the appearance of the obtained third covering layer is degraded.

In the present invention, if the thickness of the second covering layer containing a compound containing lead and phosphorus as the main component is smaller than a certain upper limit value, the uniformity of the electrodeposition of the plating layer is good at the electric plating step for forming the third covering layer, and the adhesion of the second covering layer to the third covering layer is good, with the result that a coated steel sheet having a good appearance can be obtained. In the second covering layer of the present invention, preferably the amount of the compound containing lead and phosphorus is smaller than 100 mg/m$^2$, more preferably, smaller than 25 mg/m$^2$, as calculated as the phosphorus content. If the amount of the leadphosphorus compound in the second covering layer is larger than 100 mg/m$^2$ as calculated as the phosphorus content, the adhesion between the second and third covering layers is not satisfactory, and if this coated steel sheet is subjected to a forming process, peeling of the third covering layer in a powdery form (so-called powdering phenomenon) occurs. Furthermore, in this coated steel sheet, since the third covering layer is not uniformly electrodeposited, the obtained product cannot have a uniform quality.

For formation of the second covering layer, the first covering layer of the intermediate coated steel sheet product having the first covering layer is treated with an aqueous treating liquid containing 0.1 to 100 g/l of a phosphoric acid ion ($PO_3^{-3}$), for example, an aqueous solution containing phosphoric acid and/or phytic acid (hexaphosphate ester of myoinositol), for an appropriate time, preferably 1 to 10 seconds, to modify the surface portion of the first covering layer.

If the phosphoric acid ion concentration in the aqueous treating liquid is lower than 0.1 g/l, an insufficient amount of the second covering layer is formed, and at the plating step for formation of the third covering layer, the problem of enlargement of the pinholes in the first covering or the formation of new pinholes arises. If the phosphoric acid ion concentration in the aqueous treating liquid is higher than 100 g/l, the thickness of the formed second covering layer is too large and the adhesion of the second covering layer to the third covering layer is sometimes unsatisfactory.

If the time of the treatment of first covering layer with the phosphoric acid ion-containing aqueous treating liquid is shorter than 1 second, an insufficient amount of the second covering layer is formed and a satisfactory improvement in the corrosion resistance cannot be obtained. If the treatment time is longer than 10 seconds, the thickness of the formed second covering layer is too large and the adhesion to the third covering layer is sometimes unsatisfactory.

The phosphoric acid ion-containing aqueous treating liquid is applied to and placed in contact with the surface of the first covering layer for a desired time by an operation such as spraying or dipping. After this operation is completed and the second covering layer is formed on the first covering layer, any excess treating liquid left on the surface of the second covering layer is removed by water washing, roll squeezing or high-pressure gas wiping, and the formed second covering layer is dried at a certain temperature (from normal temperature to 150° C.).

The first covering layer is composed mainly of a lead-tin eutectic alloy containing lead as the main component. Accordingly, in the second covering layer formed by the above-mentioned treatment, a compound comprising lead and phosphorus as the main elements is mainly formed, but a small amount of a tin-phosphorus compound sometimes remains therein. However, the presence of this tin-phosphorus compound does not have any particularly adverse influence on the capacity of the second covering layer.

In the coated steel sheet of the present invention, a third covering layer composed mainly of at least one metal selected from tin, nickel, and cobalt, or an alloy thereof, is formed on the so-treated second covering layer. The metal or alloy constituting the third covering layer has an excellent resistance to corrosion by an alcohol fuel or alcohol-containing fuel. Generally, the third covering layer is prepared according to an electric plating method. The hot dip coating method is not adopted. This is because the lead, tin, and the alloy thereof, used for the formation of the first covering layer have a relatively low melting point, and if the hot dip coating method is adopted for the formation of the third covering layer, the first covering layer is melted at the temperature required for hot dip coating.

Examples of the method for forming the third covering layer are as follows.

(1) Tin plating (plating with a liquid containing phenol-sulfonic acid)

Composition of plating solution:

60 g/l of stannous sulfate; 90 g/l of phenolsulfonic acid (calculated as sulfuric acid); 10 g/l of ENSA (additive)

Temperature:

normal temperature to 80° C.

Current density:

5 to 50 A/dm$^2$ (2) Nickel plating (plating in Watts bath)

Composition of plating solution:

240 g/l of nickel sulfate; 80 g/l of nickel chloride; 30 g/l of boric acid

Temperature:

normal temperature to 80° C.

Current density:

5 to 80 A/dm$^2$ (3) Nickel-cobalt alloy plating

Composition of plating solution:

120 g/l of nickel sulfate; 120 g/l of cobalt sulfate; 25 g/l of nickel chloride; 25 g/l of cobalt chloride; 45 g/l of boric acid Temperature:

normal temperature to 80° C.

Current density:

5 to 80 A/dm$^2$

The electric plating operation for the formation of the third covering may be carried out just after formation of the second covering layer is cleaned with an alkaline aqueous solution or an aqueous solution containing an acid at a very low concentration. For this cleaning treatment, the surface of the second covering layer is, for example, sprayed with or dipped in an aqueous solution containing 1 to 100 g/l of sodium orthosilicate at from normal temperature to 70° C. for 1 to 7.5 seconds. This cleaning treatment is effective for forming a uniform third covering layer.

The third covering layer clogs pinholes in the first and second covering layers, complete elimination of which is difficult, and therefore, the corrosion resistance of the obtained coated steel sheet is highly improved. Furthermore, the tin, nickel and cobalt used for the formation of the third covering layer have a very high resistance to corrosion by an alcohol fuel or alcohol-containing fuel.

Preferably, the thickness of the third layer is 0.5 to 7 μm, more preferably 1 to 5 μm.

If the thickness of the third covering layer is smaller than 0.5 μm, it is sometimes difficult to uniformly cover the first and second covering layers. Uneven covering sometimes results in an increase of the number of pinholes, the promotion of corrosion of the first and second covering layers by an alcohol fuel or alcohol-containing fuel, and a partial exposure of the first and second covering layers by defects formed on the third covering layer at the forming process step.

Even if the thickness of the third covering layer is increased to more than over 7 μm, the effect of improving the corrosion resistance of the coated steel sheet sometimes becomes saturated and formation of the third covering layer having such a large thickness is not preferred from an economical viewpoint. Moreover, if the third covering layer having a thickness larger than 7 μm is formed according to the third covering layer becomes excessively smooth. If this coated steel sheet is subjected to a forming process operation, a processing agent such as a lubrication oil sometimes cannot be properly retained on the surface and the frictional resistance of the surface of the coated steel sheet is sometime increased. Accordingly, the contact area between a processing tool such as a die and the surface of the coated steel sheet is increased, and galling occurs on the surface or cracking occurs at the forming step.

The metal or alloy constituting the third covering layer is selected from tin, nickel, cobalt, and alloys thereof. However, a third covering layer composed solely of tin or a third covering layer composed of a nickel-tin alloy, cobalt-tin alloy or nickel-cobalt-tin alloy having a tin content of at least 50% by weight, especially at least 60% by weight, is preferred for the following reasons.

The coated steel sheet for a fuel vessel is required to have (A) a high corrosion resistance, (B) an excellent forming processability, and (C) good solderability and weldability at the step of forming the coated steel sheet into a vessel.

The third covering layer composed solely of tin and the third covering layer composed of an alloy of tin and nickel and/or cobalt having a tin content of at least 50% by weight are superior to other third covering layers in solderability and weldability. These third coverting layers composed of tin or a tin alloy made it possible to rapidly and firmly solder and weld fuel injection pipes or fuel feed pipes to the fuel vessel.

When the coated steel sheet having the third covering layer composed solely of tin or composed of a tin alloy is formed into an upper tank and a lower tank, and these tanks are seam-welded to form an integral fuel vessels, this third covering layer shows a very low electric resistance value at the seam welding step. Accordingly, the applicable range of the welding current during seam-welding can be expanded, and thus the welding speed can be increased. Moreover, the formation of welding defects (such as voids formed in the welded portion by an overflow of the molten metal from welded portion and the scattering and adhesion of the overflowed metal onto the non-welded portion) is controlled and the weld strength can be improved.

Where the third covering layer is formed by using tin alone, a method may be adopted in which the covering layer of tin is heat-treated at a temperature higher than the melting point of tin (231° C.) to alloy a part of the tin with the metals of the first and second covering layers. This heat treatment is effective for clogging pinholes of the first covering layer. However, since it is necessary to maintain the greater part of the third covering layer as it is, preferably the heat treatment is carried out at 240° C. to 280° C. for 0.3 to 3 seconds. The heat treatment may be carried out in an $N_2$ gas or mixed gas atmosphere, or a method may be adopted in which an aqueous solution of tin phenol-sulfonate or an aqueous solution of zinc chloride ($ZnCl_2$) is coated as a flux on the third covering layer and the coating is heated in air.

It is necessary that this heat treatment should be such that only parts of the first and second layers are alloyed and a surface composed solely of tin is maintained in the third covering layer. Appropriate heating conditions must be selected for satisfying this requirement. If such conditions are adopted in which even the surface of the third covering layer is alloyed, the resistance to corrosion by an alcohol fuel or alcohol-containing fuel is reduced.

The advantages of the coated steel sheet of the present invention are as follows.

(1) By laminating the first, second, and third layers, the number of pinholes in the covering is kept very low.

(2) The metal or alloy constituting the third covering layer forming the surface of the coated steel sheet has a high sacrificing anticorrosive effect against water of chlorine ions ($Cl^-$) contained in fuel or air, which cause pitting in the coated steel sheet. Accordingly, even if pinholes are present in the third covering layer, this sacrificing anticorrosive effect prevents corrosion of the first and second covering layers.

(3) It is important that at least first and second covering layers should be present between the steel sheet in the substrate and the third covering layer. Namely, the metal used for formation of the third covering layer is potentially nobler than steel, and therefore, if a covering layer having the same composition as that of the third covering layer is directly formed on the steel sheet, corrosion of the steel sheet in the pinhole portion is promptly advanced and there is a great risk of red rust or pitting. In order to solve this problem, it is necessary that the thickness of the covering layer should be increased. However, an increase of the thickness of this covering layer will result in a reduction of the forming processability of the obtained coated steel sheet, and the product becomes disadvantageous from the economical viewpoint.

In the coated steel sheet of the present invention, by interposing the first and second covering layers between the steel sheet of the substrate and the third covering layer, the corrosion resistance can be improved without reducing the forming processability.

(4) Since the first covering layer (lead-tin alloy layer) formed on the substrate is soft and has an excellent lubricating property, the obtained coated steel sheet has a good forming processability and the formation of cracks extending to the surface is controlled. This effect of controlling the formation of cracks provides a great improvement in the corrosion resistance of the coated steel sheet.

Because of these advantages, the coated steel sheet of the present invention is very valuable as a material for forming a highly anticorrosive fuel vessel.

The coated steel sheet of the present invention has an excellent corrosion resistance to an alcohol fuel or alcohol-containing fuel and is suitable as a material for the production of a vessel for containing a fuel of this type. Note, the inner side of the fuel vessel only may be covered with the coating of the present invention by using a steel sheet material having the coating layer on one surface, or the coating layer of the present invention may be formed on both surfaces of the steel sheet as the substrate so that the outer side of the fuel vessel also can be protected from corrosion by the external atmosphere. Where the coating layer of the present invention is formed on only one surface of the steel sheet as the substrate, the other surface may be in any on the following states.

(1) No covering layer is formed and therefore, the surface of the steel sheet substrate is exposed.

(2) Only the first covering layer is formed.

(3) The first and second covering layers are formed.

(4) A covering layer composed of a zinc-nickel (8 to 20% by weight) alloy, a zinc-cobalt (8 to 20% by weight) alloy, a zinc-nickel or cobalt (8 to 20% by weight) alloy, or a zinc-iron (8 to 20% by weight) alloy is formed.

In the coated steel sheet of the present invention, the surface portion of the third covering layer may be modified by a chemical conversion treatment with an aqueous solution containing at least one member selected from a phosphoric acid ion ($PO_4^{-3}$) and a chromic acid or ion, such as an aqueous solution of phosphoric acid or phytic acid, an aqueous solution of chromic acid, or an aqueous solution containing chromic acid and other anion. This chemical forming treatment may be accomplished by dipping or electrolysis.

The chemical modifying treatment of the surface portion of the third covering layer is effective for reducing the number of pinholes and improving the adhesion of the coated steel sheet to various coating agents such as an anticorrosive coating agent and a decorative coating agent.

The chemical conversion treatment using an aqueous solution containing a phosphoric acid ion is most preferred because the effect of chemically modifying the third covering layer is high and the solderability or weldability is not degraded.

The chemical conversion treatment using an aqueous solution containing a phosphoric acid ion is most preferred because the effect of the chemically modifying the third covering layer is high and the solderability or weldability is not degraded.

The chemical conversion treatment with an aqueous solution containing a phosphoric acid ion may be carried out according to customary procedures. For example, the coated steel sheet may be treated with an aqueous solution containing 0.1 to 100 g/l of a phosphoric acid ion for 1 to 10 seconds. The treatment may be accomplished by spraying, dipping or electrolysis. By this treatment, the surface portion of the third covering layer is modified into a phosphorus-containing film layer.

If the phosphoric acid ion concentration is lower than 0.1 g/l, the effects of improving the corrosion resistance in the coated steel sheet and improving the coating adaptability are not satisfactory, and if the phosphoric acid ion concentration exceeds 100 g/l in the treating solution, the thickness of the modified surface portion is excessively increased and the solderability and weldability of the coated steel sheet are sometimes degraded.

If the treatment time is shorter than 1 second, the modification of the surface portion of the third covering layer is often insufficient, and if the treatment time is longer than 10 seconds. the thickness of the formed modified portion is excessively increased and the solderability, weldability and appearance are sometimes degraded.

After completion of the chemical conversion treatment, the treating solution is removed by water washing, roll squeezing or high pressure gas wiping, and the control steel sheet is dried at from normal temperature to 150° C.

The amount of the surface portion of the third covering layer modified with the phosphoric acid ion-containing aqueous solution is preferably 0.1 to 100 mg/m$^2$, especially preferably 0.5 to 10 mg/m$^2$, as calculated as the phosphorus content. The amount of this modified surface portion can be appropriately determined in view of the solderability, weldability, corrosion resistance, and coating adaptability required for the coated steel sheet.

The coated steel sheet of the present invention is valuable for the production of a vessel for containing alcohol fuel or alcohol-containing fuel and is also valuable for the production of a vessel for containing a fuel composed mainly of gasoline.

The present invention will now be described in detail with reference to the following examples.

EXAMPLE 1

A cold-rolled steel strip was subjected to customary degreasing, pickling, and water washing treatments to clean and activate the surface of the strip.

A lead-10% by weight tin alloy coating layer (first covering layer) having a thickness of 4 μm was formed on both surfaces of the strip by electric plating.

The steel strip having the first covering layer was dipped in an aqueous solution containing 0.2% of phosphoric acid at 50° C. for 10 seconds, followed by roll squeezing and drying, whereby a phosphorus-lead compound layer (second covering layer) having a phosphorus content of 5 mg/m$^2$ was formed.

The strip having the first and second covering layers was electrically plated by using a ferrostannous plating solution to form a tin plating layer (third covering layer) having a thickness of 1.5 μm. The obtained coated steel sample (0.8 mm×300 mm×500 mm) was draw-formed into a square cylinder at a drawing depth of 100 mm to obtain a draw-formed sample (a) or was draw-formed into a square cylinder at a drawing depth of 110 mm to obtain a draw-formed sample (b). Each sample was tested according to the following methods.

(A) Test of corrosion of outer surface by salt spraying

The sample (blank) before the draw-forming was subjected to the salt spray test for 96 hours, and the draw-formed sample (a) was subjected to the salt spray test for 48 or 96 hours.

The number of red rust spots appearing on the tested sample was counted and the corrosion resistance was evaluated according to the following scale.

| Class | Evaluation | Evaluation Standard |
|---|---|---|
| 4 | excellent | up to 3 red rust spots per dm$^2$ |
| 3 | good | 4 to 10 red rust spots per dm$^2$ |
| 2 | not good | 11 to 19 red rust spots per dm$^2$ |
| 1 | bad | at least 20 red rust spots per dm$^2$ |

(B) Gasoline corrosion resistance test

The draw-formed sample (b) was filled with gasoline containing 1% by weight of sodium chloride and 20% by weight of water, and the filled sample was allowed to stand for 12 months while exchanging the content with fresh constituents once a month. The amount of red rust on the sample, the discoloration of the covering layer, and the amount of corrosion were examined, and an evaluation was made in the same manner as described above.

(C) Alcohol gasoline (gasohol) corrosion test

The draw-formed sample (b) was filled with (1) mixed gasoline containing 10% by weight of methyl alcohol, (2) mixed gasoline containing 10% by weight of methyl alcohol and 5% by weight of an aqueous solution containing 0.5% by weight of sodium chloride, (3) mixed gasoline containing 9.9% by weight of methyl alcohol and 0.1% by weight of formic acid, or (4) mixed gasoline containing 9% by weight of ethyl alcohol and 1% by weight of an aqueous solution containing 0.001% by weight of acetic acid, and the filled sample was allowed to stand for 12 months while exchanging the content with fresh constituents once a month. The amount of red rust on the sample and the discoloration or amount of corrosion of the covering layer were examined, and the evaluation was carried out in the same manner as described above.

(D) Alcohol corrosion test

The draw-formed sample (b) was filled with (1) ethyl alcohol containing 5% by weight of water or (2) methyl alcohol, and the filled sample was allowed to stand for 12 months while exchanging the content with fresh constituents once a month. The amount of red rust on the sample and the amount of corrosion or discoloration of the covering layer were examined. The evaluation was carried out in the same manner as described above.

The obtained results are shown in Table 1.

EXAMPLE 2

The same cleaned steel strip as used in Example 1 was dipped in a lead-15% by weight tin alloy coating bath at 350° C. for 65 seconds according to the wet flux method, and a layer of the above-mentioned lead-tin alloy having a thickness of 5 μm (first covering layer) was formed according to a plating amount-controlling method using a high-pressure gas.

The obtained covered steel strip was air-cooled and water-cooled to 60° C. and was then sprayed at 60° C. for 5 seconds with an aqueous solution of phosphoric acid having a concentration of 0.3%. The coating amount was controlled by high-pressure air and the coated steel strip was dried to form a second covering layer having a coating amount of 19 mg/m$^2$, as calculated as the phosphorus content.

A nickel-cobalt (20% by weight) alloy plating layer having a thicness of 3 μm (third covering layer) was formed according to the electric plating method using a plating solution containing nickel sulfate, cobalt sulfate, nickel chloride, cobalt chloride, and boric acid.

The obtained coated steel strip was tested in the same manner a in Example 1. The obtained results are shown in Table 1.

EXAMPLE 3

The same steel strip as described in Example 1 was plated to form a nickel plating layer a thickness of 0.1 μm (undercoat covering layer and the obtained steel strip substrate was dipped in a lead-8% by weight tin alloy coating liquid at 350° C. for 7 seconds, and the coating amount was controlled a high-pressure gas to form a lead-tin (8% by weight) coating layer having a thickness of 3.5 μm (first layer).

The coated steel strip was cooled to 80° C. an treated with the same aqueous solution of phosphoric acid as used in Example 1, and the coating amount was controlled by adjusting the roll squeezing pressure, whereby a second covering layer having a coating amount of 2.5 mg/m$^2$ as calculated as the phosphorus content was formed.

The steel strip having the undercoat and first and second covering layers was electrically plated by using a forrostan plating bath to form a tin plating layer having a thickness of 1 μm (third covering layer).

The obtained coated steel strip was tested in the same manner as described in Example 1. The obtained results are shown in Table 1.

EXAMPLE 4

The same cleaned steel strip as used in Example 1 was electrically plated to form a nickel-cobalt (5% by weight) alloy plating layer having a thickness of 0.5 μm as the undercoat covering layer.

The coated steel strip having the undercoat covering layer was dipped in a lead-tin (8.5% by weight) alloy coating bath at 360° C. for 5 seconds, and the coating amount was controlled by a high-pressure gas, whereby a lead-tin alloy coating layer having a thickness of 6 μm was formed as the first covering layer.

The coated steel strip was cooled to 60° C. and a 0.5% aqueous solution of phytic acid was sprayed at 70° C. for 8 seconds on the surface of the first covering layer and the coating amount was controlled by high-pressure air, followed by drying, to form a second covering layer composed of a phosphorus-lead compound, which had a coating amount of 25 mg/m$^2$ as calculated as the phosphorus content.

The coated steel strip was subjected to electric-plating using ferrostannous plating solution to form a tin plating layer having a thickness of 2 μm as the third covering layer.

The third covering layer was subjected to a surface-modifying treatment using 0.75% aqueous solution of phosphoric acid at 80° C. for 7.5 hours to modify the surface portion of the third covering layer.

The obtained coated steel strip was tested in the same manner as described in Example 1. The obtained results are shown in Table 1.

EXAMPLE 5

The same cleaned steel strip as used in Example 1 was electrically plated with cobalt to form an undercoat covering layer having a thickness of 0.03 μm.

The steel strip having this undercoat covering layer was dipped in a lead-tin (11% by weight) alloy coating liquid at 370° C. for 7.5 seconds and the coating amount was controlled by a high-pressure gas to form a first covering layer of the lead-tin (11% by weight) alloy having a thickness of 5 μm. Then, the coated steel strip was treated in the same manner as described in Example 2 except that the pressure of the high-pressure gas was changed to control the amount formed of the second covering layer to 15 mg/m$^2$, as calculated as the phosphorus content.

The coated steel strip was electrically plated with nickel by using a Watts bath containing nickel sulfate, nickel chloride, and boric acid to form a third covering layer having a thickness of 2.5 μm.

The coated steel strip was subjected to a cathodic electrolysis treatment in a treating liquid containing 100 g/l of $CrO_3$—$SO_4^{-2}$ at a current density of 10 A/cm$^2$ at 60° C. for 1 second to modify the surface portion of the third covering layer.

The obtained coated steel strip was tested in the same manner as described in Example 1. The obtained results are shown in Table 1.

EXAMPLE 6

By the same operations as described in Example 1, first second and third covering layers were formed, and the obtained coated steel strip was treated in a 0.5% aqueous solution of phosphoric acid at 70° C. for 9 seconds to modify the surface portion of the third covering layer.

The obtained coated steel strip was tested in the same manner as described in Example 1. The obtained results are shown in Table 1.

COMPARATIVE EXAMPLE 1

The first covering layer-forming plating operation described in Example 2 was carried out, and the third covering layer-forming plating operation described in Example 1 was then carried out without performing the second covering layer-forming treatment.

The obtained comparative coated steel strip was tested in the same manner as described in Example 1. The obtained results are shown in Table 1.

COMPARATIVE EXAMPLE 2

The same first covering layer-forming operation as described in Example 1 was carried out and the same third covering layer-forming plating treatment as described in Example 2 was carried out without performing the second covering layer forming treatment.

The obtained comparative coated steel strip was tested in the same manner as described in Example 1. The obtained results are shown in Table 1.

COMPARATIVE EXAMPLE 3

The procedures of Comparative Example 1 were repeated in the same manner except that the third covering layer of the obtained coated steel strip was subjected to the same surface-modifying treatment as described in Example 4.

The obtained comparative coated steel strip was tested in the same manner as described in Example 1. The obtained results are shown in Table 1.

COMPARATIVE EXAMPLE 4

The procedures of Example 3 were repeated in the same manner except that the second covering layer-forming treatment was not carried out.

The obtained comparative coated steel strip was tested in the same manner as described in Example 1. The obtained results are shown in Table 1.

COMPARATIVE EXAMPLE 5

The first covering layer-forming plating operation was carried out in the same manner as described in Example 2, but the subsequent second covering layer-forming and third covering layer-forming operations were omitted.

The obtained comparative coated steel strip was tested in the same manner as described in Example 1. The obtained results are shown in Table 1.

COMPARATIVE EXAMPLE 6

The same undercoat and first covering layer-forming plating operations as described in Example 1 were carried out, but the subsequent operations of forming the second and third covering layers were omitted. Then, the same surface portion-modifying treatment as described in Example 4 was carried out.

The obtained comparative coated steel strip was tested in the same manner as described in Example 1. The obtained results are shown in Table 1.

TABLE 1

| Example No. | Corrosion Test of Outer Surface by Salt Spraying: Non-Draw-Formed Steel Sheet 96 hrs. | Draw-Formed Steel Sheet (a) 48 hrs. | Draw-Formed Steel Sheet (a) 96 hrs. | Gasoline Corrosion Test of Draw-Formed Steel Sheet (b) | Alcohol-Containing Fuel Corrosion Test of Draw-Formed Steel Sheet (b): Gasoline/Methyl Alcohol Mixed Liquid 12 months | Gasoline/Methyl Alcohol/Aqueous Sodium Chloride Mixed Liquid 12 months | Gasoline/Methyl Alcohol/Formic Acid Mixed Liquid 12 months | Gasoline/Methyl Alcohol/Acetic Acid Mixed Liquid 12 months | Alcohol Fuel Corrosion Test of Draw-Formed Steel Sheet (b): Water-Containing Ethyl Alcohol | Methyl Alcohol |
|---|---|---|---|---|---|---|---|---|---|---|
| Example 1 | 4 | 4 | 3 | 4–3 | 4 | 4–3 | 4–3 | 3 | 3 | 3 |
| 2 | 4 | 4 | 3 | 4–3 | 4 | 4–3 | 4–3 | 3 | 3 | 3 |
| 3 | 4 | 4 | 3 | 4–3 | 4 | 4–3 | 4–3 | 3 | 3 | 3 |
| 4 | 4 | 4 | 4 | 4 | 4 | 4 | 4 | 4 | 4 | 4 |
| 5 | 4 | 4 | 4 | 4 | 4 | 4 | 4 | 4 | 4 | 4 |
| 6 | 4 | 4 | 4 | 4 | 4 | 4 | 4 | 4 | 4 | 4 |
| Comparative 1 | 4 | 3 | 2 | 1 | 3 | 3 | 3 | 2 | 2 | 3 |
| 2 | 4 | 2 | 1 | 1 | 2 | 2 | 3 | 2 | 2 | 3 |
| 3 | 4 | 2 | 1 | 2 | 3 | 2 | 3 | 2 | 2 | 3 |
| Example 4 | 4 | 2 | 1 | 1 | 2 | 3 | 3 | 2 | 2 | 3 |
| 5 | 1 | 1 | 1 | 1 | 2–1 | 1 | 1 | 1 | 1 | 2 |
| 6 | 4 | 2 | 1 | 4 | 2 | 2 | 2 | 2 | 2 | 2 |

We claim:

1. A highly anticorrosive coated steel sheet for a fuel vessel, which comprises (A) a substrate composed of (a) a steel sheet and (b) at least one undercoat covering layer formed on at least one surface of the steel sheet and composed of at least one member selected from the group consisting of nickel, cobalt and copper, (B) at least one first covering layer formed on the undercoat covering layer and comprising, as a main component, an alloy of lead and tin, (C) at least one second covering layer formed on the first covering layer and comprising a compound of lead with phosphorous, and (D) at least one third covering layer formed on said second covering layer and comprising, as a main compound, at least one member selected from the group consisting of tin, nickel cobalt and alloys of at least two of the above-mentioned metals.

2. A coated steel sheet as set forth in claim 1, wherein said undercoat covering layer has a thickness of 0.01 μm to 1 μm.

3. A coated steel sheet as set forth in claim 1, wherein said first covering layer has a tin content in said alloy of lead and tin which is in the range of from 3% to 30% by weight.

4. A coated steel sheet as set forth in claim 1, wherein a thickness of said first covering layer is in the range of from 1.5 μm to 10 μm.

5. A coated steel sheet as set forth in claim 1, wherein said compound containing lead and phosphorous in said second covering layer has a phosphorous content not exceeding 100 mg/m$^2$.

6. A coated steel sheet as set forth in claim 5, wherein said compound containing lead and phosphorous has a phosphorous content in the range of from 0.1 to 100 mg/m$^2$.

7. A coated steel sheet as set forth in claim 1, wherein said third covering layer has a thickness in the range of from 0.5 to 7 μm.

8. A coated steel sheet as set forth in claim 1, wherein a surface portion of said third covering layer is modified by a chemical conversion treatment.

9. A coated steel sheet as set forth in claim 8, wherein said surface portion of said third covering layer is modified with a chemical conversion agent containing at least one member selected from a phosphoric acid ion and a chromic acid ion.

10. A coated steel sheet as set forth in claim 8, wherein said modified surface portion of said third covering layer contains phosphorous in a content in the range of from 0.1 to 100 mg/m$^2$.

11. A process for the production of a highly anticorrosive coated steel sheet for a fuel vessel, which comprises forming, by electroplating or hot dipping, a first covering layer containing an alloy of lead and tin as a main component on at least one surface of substrate composed of a steel sheet, subjecting said first covering layer to a treatment with an aqueous treating liquid containing a phosphoric acid ion at a concentration of 0.1 to 100 g/l for 1 to 10 seconds to form a second covering layer containing a compound containing lead and phosphorous on said first covering layer, and forming, by electroplating, a third covering layer containing a metal selected from tin, nickel and cobalt or an alloy thereof as a main component on said second covering layer.

12. A process according to claim 11, wherein said substrate is formed by forming an undercoat covering layer composed of at least one member selected from nickel, cobalt and copper on said at least one surface of the steel sheet.

13. A process according to claim 11, wherein a surface portion of said third covering layer is treated with a chemical conversion agent containing at least one member selected from a phosphoric acid ion and chromic acid ion to modify said surface portion of said third covering layer.

14. A process according to claim 11, wherein said chemical conversion treatment is carried out with a treating agent containing a phosphoric acid ion at a content of 0.1 to 100 mg/l for 1 to 100 seconds.

* * * * *

UNITED STATES PATENT AND TRADEMARK OFFICE
CERTIFICATE OF CORRECTION

PATENT NO. : 4,946,748

DATED : August 7, 1990

INVENTOR(S) : Higuchi, et al.

It is certified that error appears in the above-identified patent and that said Letters Patent is hereby corrected as shown below:

Col. 1, line 37, change "as" to --an--.

Col. 2, lines 58-60, change "contained in the fuel or the $Cl^-$ ion or water contained in the surrounding atmosphere" to --coming into contact with $Cl^-$ ions or water contained in the fuel or the surrounding atmosphere--.

Col. 2, line 10, change "as" to --has--.

Col. 4, line 63, after "and/or" add --antimony--.

Col. 5, line 60, change "leadphos-" to --lead-phos--.

Col. 7, line 43, change "layer is" to --layer which is--.

Col. 8, line 38, change "coverting" to --covering--.

Col. 9, line 20, change "of" to --or--.

Col. 10, line 20, change "or ion" to --ion--.

UNITED STATES PATENT AND TRADEMARK OFFICE

CERTIFICATE OF CORRECTION

PATENT NO. : 4,946,748

DATED : August 7, 1990

INVENTOR(S) : Higuchi, et al.

It is certified that error appears in the above-identified patent and that said Letters Patent is hereby corrected as shown below:

Col. 12, line 55, change "a" to --as described--.

Col. 12, line 59, change "same" to --same cleaned--.

Col. 12, line 60, change "plated" to --electrically plated--.

Col. 12, line 60, change "layer a" to --layer having a--.

Col. 12, line 61, change "layer" to --layer),--.

Col. 12, line 67, change "an" to --and--.

Col. 16, line 63, change "11" to --13--.

Signed and Sealed this

Eleventh Day of February, 1992

*Attest:*

HARRY F. MANBECK, JR.

*Attesting Officer*

*Commissioner of Patents and Trademarks*